US010971857B2

(12) United States Patent
Nguyen et al.

(10) Patent No.: US 10,971,857 B2
(45) Date of Patent: Apr. 6, 2021

(54) CABLE EXTRACTION TOOL

(71) Applicant: Level 3 Communications, LLC, Broomfield, CO (US)

(72) Inventors: Joseph Nguyen, Denver, CO (US); Joel S. Skoglund, Brighton, CO (US)

(73) Assignee: Level 3 Communications, LLC, Broomfield, CO (US)

( * ) Notice: Subject to any disclaimer, the term of this patent is extended or adjusted under 35 U.S.C. 154(b) by 818 days.

(21) Appl. No.: 14/883,960

(22) Filed: Oct. 15, 2015

(65) Prior Publication Data

US 2017/0110832 A1 Apr. 20, 2017

(51) Int. Cl.
*H01R 13/633* (2006.01)
*H01R 13/627* (2006.01)

(52) U.S. Cl.
CPC ..... *H01R 13/6335* (2013.01); *H01R 13/6272* (2013.01)

(58) Field of Classification Search
CPC ..... H01R 13/6335; H01R 13/633; H01R 13/629; H01R 13/6272; H01R 13/627; H01R 13/62; H01R 43/26; Y10T 29/53283
USPC ..... 81/52, 44, 436; 439/341, 376, 354, 542, 439/372, 352, 358; 29/764, 426.1, 426.5, 29/426.6, 278
See application file for complete search history.

(56) References Cited

U.S. PATENT DOCUMENTS 849,980 A * 4/1907 Danforth ..... B66C 1/48 294/102.1
1,281,069 A * 10/1918 Rieber ..... H01K 3/32 81/53.11
1,616,121 A * 2/1927 Gruber ..... B25B 7/00 294/104
3,422,521 A * 1/1969 Beinhaur ..... H05K 13/0007 29/764
3,628,221 A * 12/1971 Pasbrig ..... A44B 11/16 403/18
4,005,897 A * 2/1977 Smith ..... A01K 97/14 294/115
4,290,193 A * 9/1981 Anderton ..... H01R 43/26 29/278
4,425,704 A * 1/1984 Cline ..... H01R 43/00 29/235

(Continued)

FOREIGN PATENT DOCUMENTS

DE WO 2015101500 A1 * 7/2015 ..... H01R 13/6272

*Primary Examiner* — Orlando E Aviles
*Assistant Examiner* — Joel D Crandall

(57) ABSTRACT

A tool 202 for extracting a cable plug 112 from a socket 203 including a cable remover portion 206 which actuates and disconnects the cable plug 112 is described and claimed. Various implementations include a user statically or dynamically actuating and gripping the plug 112 and mechanically or frictionally gripping, or both, the plug 112. In one implementation, the cable remover portion 206 includes a ball detent 302 and catch tabs 320 which actuate the cable clip 208 and catch the cable head 210 so that the plug 112 is mechanically gripped. In another implementation, a translational ramp 800 is supported in the cable remover portion 206 so that a user dynamically moves the ramp 800, which actuates the cable clip 208 and the force of the ramp 800 and cable remover 206 together frictionally grips the plug 112.

6 Claims, 15 Drawing Sheets

(56) References Cited

U.S. PATENT DOCUMENTS

| | | | | | |
|---|---|---|---|---|---|
| 4,784,025 | A * | 11/1988 | Peck | B25C 3/008 | 81/44 |
| 4,854,626 | A * | 8/1989 | Duke | A01K 97/14 | 294/104 |
| 5,438,748 | A * | 8/1995 | Matsuzawa | H01R 13/4362 | 29/752 |
| 7,063,554 | B2 * | 6/2006 | Kuiken | H01R 23/10 | 385/86 |
| 9,401,577 | B2 * | 7/2016 | Mitchell | H01R 43/26 | |
| 2002/0142649 | A1 * | 10/2002 | Baugh | H01R 13/633 | 439/532 |
| 2004/0200060 | A1 * | 10/2004 | Shutts | H01R 43/0421 | 29/751 |
| 2005/0067847 | A1 * | 3/2005 | Zellak | G02B 6/3807 | 294/100 |
| 2007/0270016 | A1 * | 11/2007 | Boyd | H01R 13/6272 | 439/354 |
| 2008/0172800 | A1 * | 7/2008 | Levy | B25B 27/00 | 7/107 |
| 2013/0326854 | A1 * | 12/2013 | Kady | B25B 5/068 | 29/426.5 |

* cited by examiner

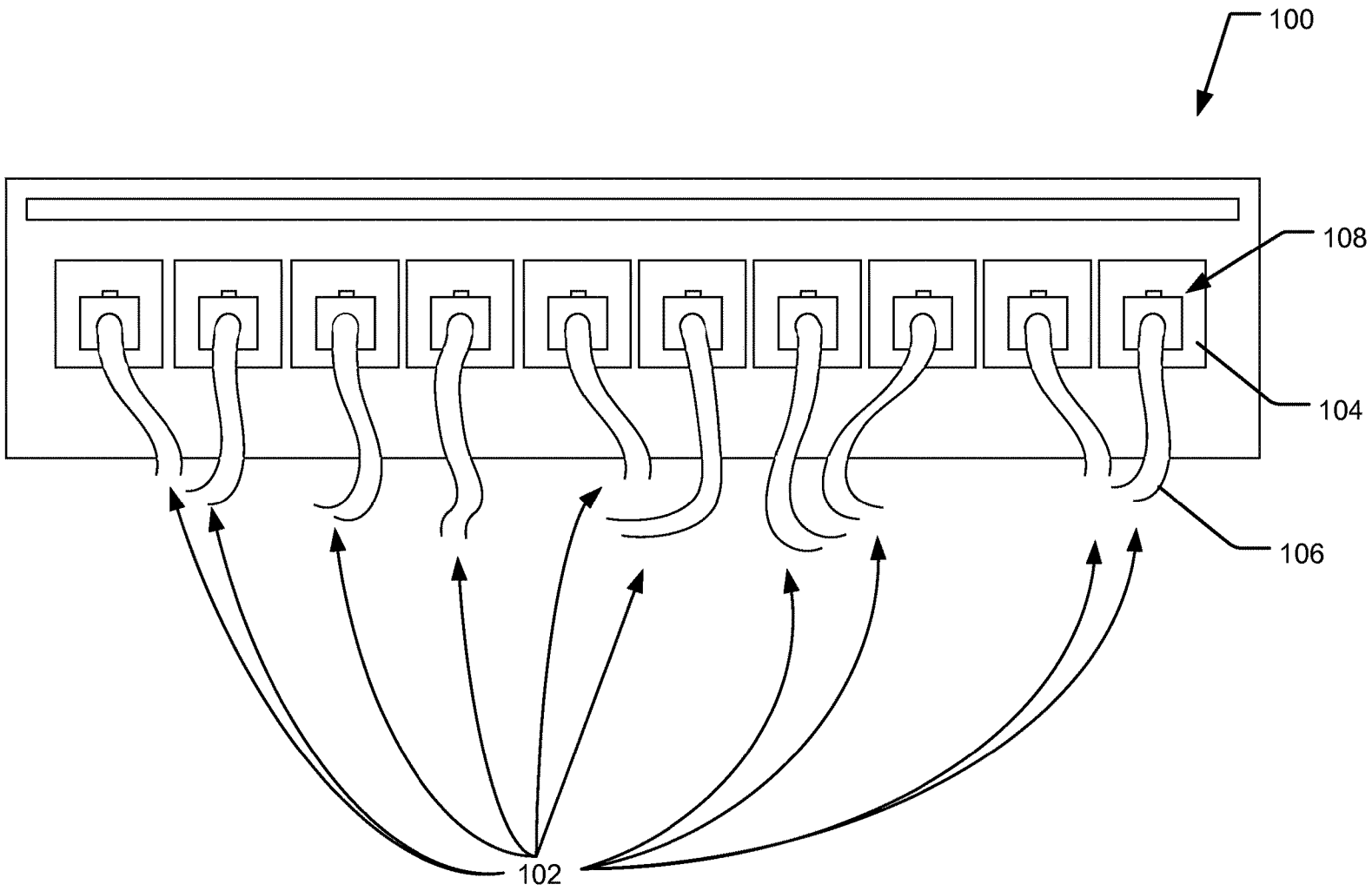
FIG. 1 (Background)

CABLE EXTRACTION TOOL

TECHNICAL FIELD

Aspects of the present disclosure relate to tools for disconnecting and removing a cable, and more particularly to disconnecting and removing a cable head and a cable clip from a cable socket.

BACKGROUND

Computing equipment, particularly for large networks, often have numerous cables connected to the back of the equipment. For example, FIG. 1 (Background) illustrates the back panel 100 of a typical computing device with numerous cables 102 plugged into sockets 104 in the back of the machine. Often, as shown, the cable connections are tightly spaced and when computing equipment is stacked, such as in a rack, the cables 102 from many different devices can be bundled and routed in close proximity to other machines making the working space tight. An individual cable 106 and cable plug 108 can be difficult to locate, grasp, extract and reinsert, in such an environment making the possibility of erroneously disconnecting an incorrect cable possible. Furthermore, disconnecting the wrong cable can cause a network or computer system outage, which is undesirable particularly in hosting environments or large network environments were potentially many applications or services could be affected.

It is with these observations in mind, among others, that various aspects of the present disclosure were conceived and developed.

SUMMARY

Implementations described and claimed herein address the foregoing problems, among others, by providing a tool for extracting a cable from a cable socket. In one implementation, a tool includes a shaft and an alignment member supported on the shaft. The alignment member includes a transverse member with a bounding member extending from the transverse member. The bounding member includes a third member extending from the bounding member, which is separated from the transverse member by a first distance spacing the transverse member. The first distance separating the transverse member and the third member is spaced to receive a cable plug. The tool also includes a disconnecting member supported on the alignment member where the disconnecting member includes an actuating member that reduces the first distance between the transverse member and the third member to actuate a cable clip portion of the cable plug and a gripping member that will grab the cable head for disconnection from a socket.

BRIEF DESCRIPTION OF THE DRAWINGS

FIG. 1 (Background) illustrates the back panel of a typical computing device with numerous cables plugged into sockets in the back of the machine.

DETAILED DESCRIPTION

Figure 2A:
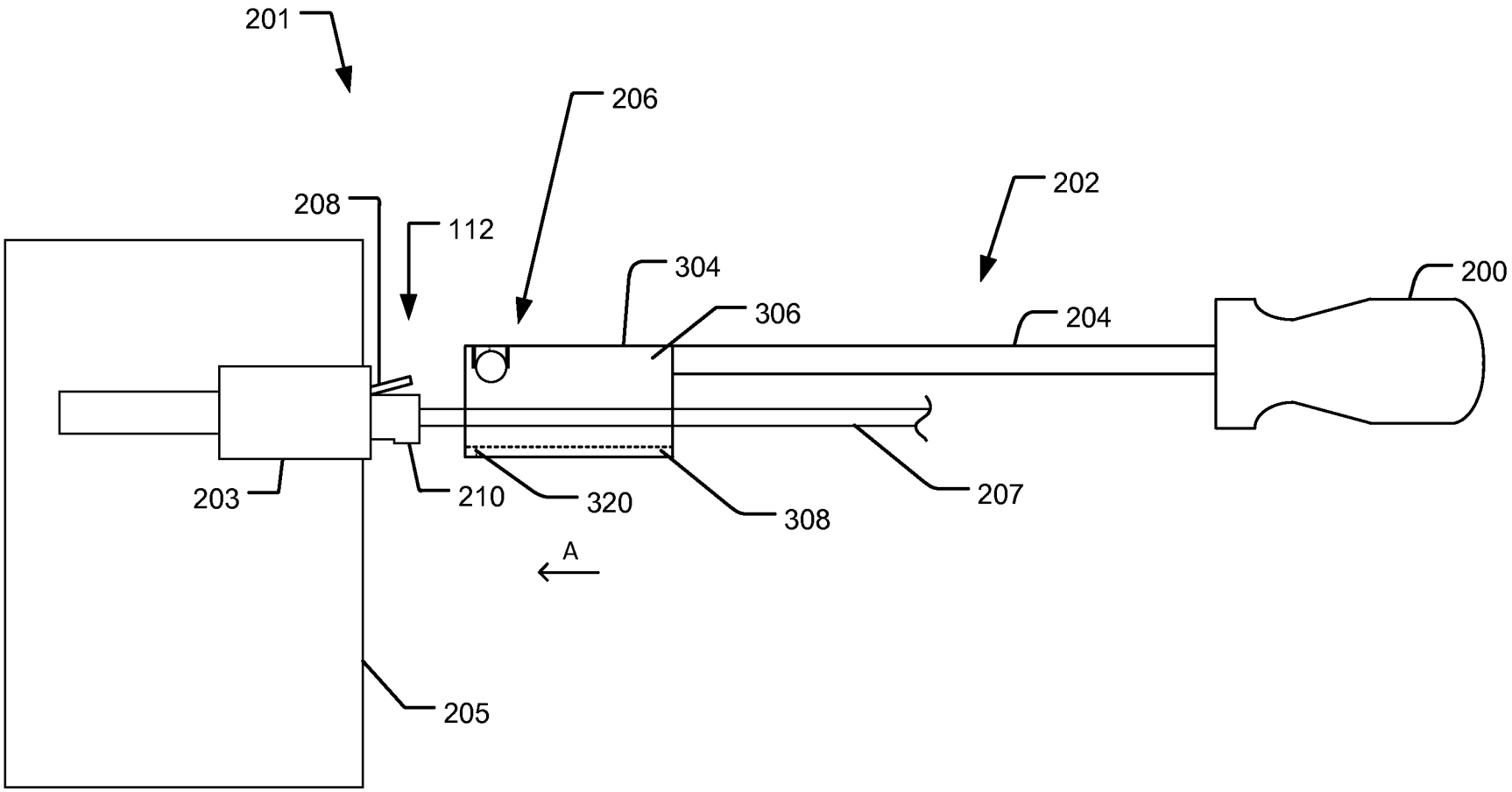
FIGS. 2A and 2B illustrate a side view of an example system for extracting a cable from a socket, showing the cable unreceived and received in the cable extraction tool, respectively.

The various apparatuses disclosed herein generally provide for the location and removal of a cable 207 and plug 112 from a cable socket 203, as well as the insertion of a plug 112 into a socket 203. More particularly, a cable extraction tool 202 is presented that allows a cable 207 to be followed to its plug 112, that allows the tool 202 to grasp the plug 112 and actuate a tab 208 on the plug 112 to unlock it from a socket 203 in which it is plugged, and grasp the plug 112 for extraction from the socket 203. The tool 202 can be configured to fit various different cable plugs, such as an SC cable, an LC connector, an RJ45 connector, and an RJ11 connector. This list is not meant to be exhaustive and the tool 202 can be configured to fit other similar cables and connectors. Although the description set out herein primarily discusses removal, the tool 202 is also useful for plugging a cable plus 207 into a socket 203 among other things. By following the cable 207 to its plug 112, the tool 202 helps a user to identify and disconnect the correct plug 112. By providing a mechanism whereby the plug 112 may be grasped and disconnected, the tool 202 avoids a user inadvertently disconnecting the incorrect plug and also helps a user, particularly in tight spaces, to not interfere with adjacent plugs and accidently disconnect an adjacent plug or damage adjacent plugs or cables. Moreover, particularly with relatively small plugs, the tool can be more effective than finger tips in manipulating and actuating the plug.

Figure 2B:
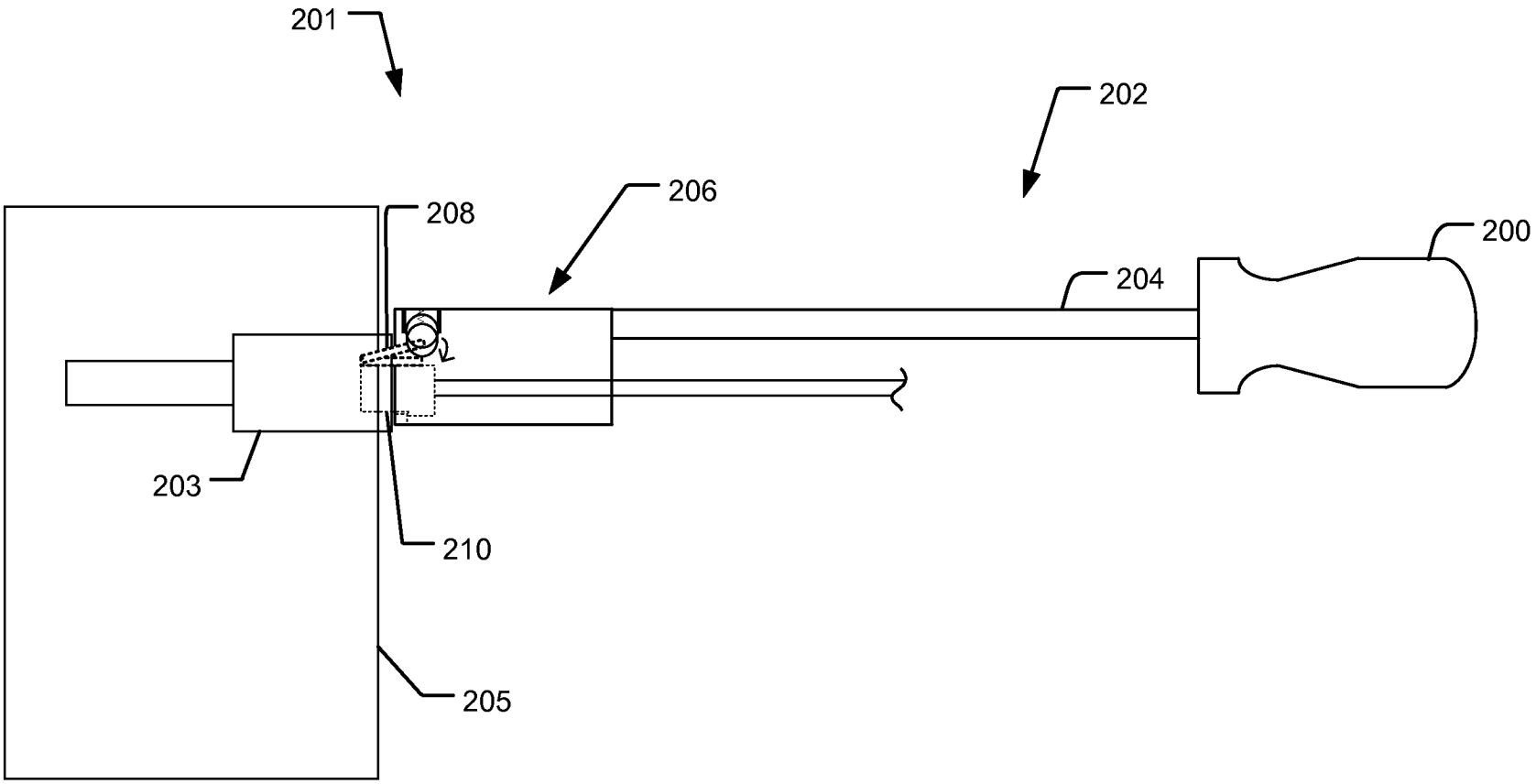
Figure 3:
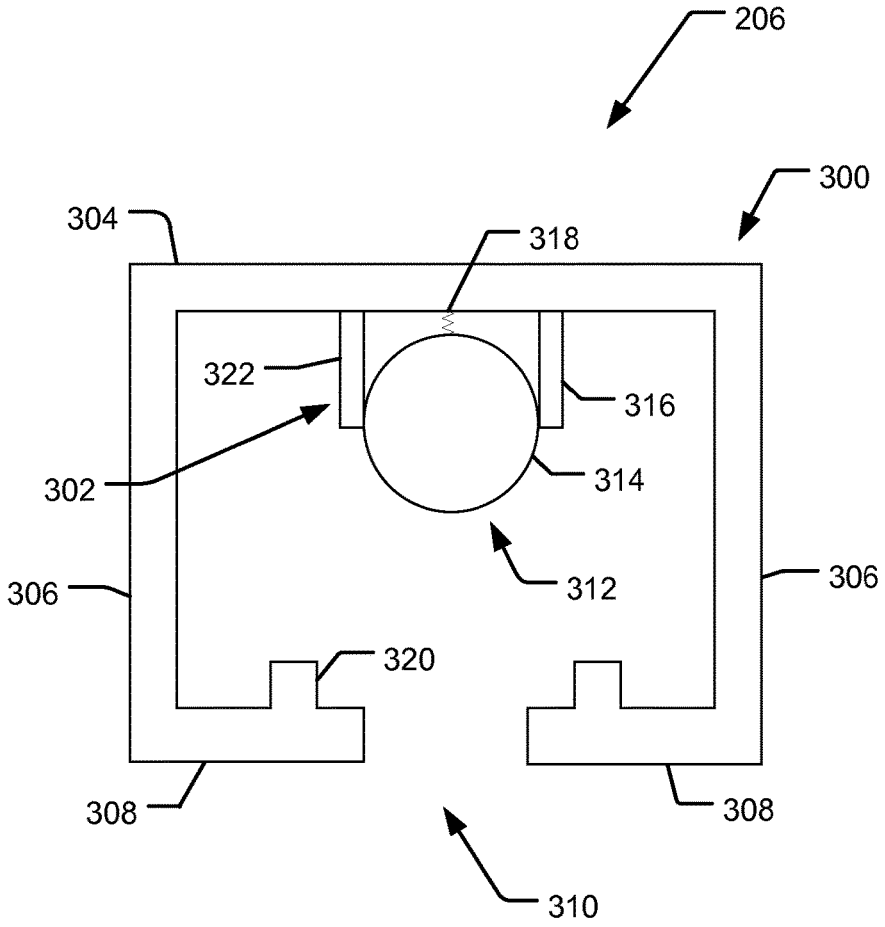
FIG. 3 shows a front detailed view of an example cable remover portion of the cable extraction tool.
Figure 4:
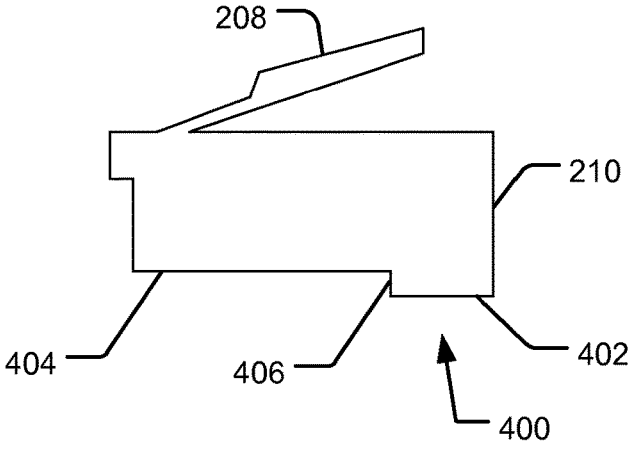
FIG. 4 shows a side detailed view of a cable plug.

To begin a detailed description of an example cable extraction tool 202, reference is made to FIGS. 2-4, which illustrate a side view of a cable extraction tool 202, a side view of a cable 201 and the cable extraction tool 202 actuating the cable 212, a front view emphasizing a cable remover 206 portion of the tool, and a detailed side view of a cable plug, respectively. More specifically, the cable extraction tool 202 has a cable remover 206 supported on a shaft 204 and a handle 200 also supported on the shaft 204. The handle 200 may be offset, for example, the shaft 204 may be bent or angled, and allows a user to hold and use the cable extraction tool 202. The shaft 204 allows a user to position the cable remover 206 on a cable 212 while keeping the user's hand away from the cable plug and allowing the user to insert the tool into a densely spaced tangle of cables and extract a particular cable. The shaft 204 may be straight, as shown, or may include an offset or angled portion. One benefit of the arrangement is when there are many cables packed tightly together and there is little room to disconnect a cable by hand, the shaft 204 allows a user to position the cable remover 206 without having to reach his or her hand into the actual cable bundle.

For simplicity, a single cable plug 212 is shown plugged into a socket 203 at the back of a machine 205. The cable remover 206 acts as a guide on the cable 212. A user can identify a specific cable 212 to extract and position the cable remover 206 over the cable 212 at a distance away from the plug. When the user moves the tool 200 towards the plug, the cable remover 206 can follow the cable 212, keeping the cable 212 inside the cable remover 206, and visually aid the user so the user can track the correct cable 212. More specifically, the opening 310 allows the cable remover to receive the cable 207 at a point away from the plug 112 and allows the cable remover 206 to slide along the cable 207 as the user moves the tool 202 towards the plug 112. When properly positioned, the cable remover 206 surrounds the plug 112 and actuates the cable clip 208 to unlock the plug 112 from the socket 205. The cable remover 206 also grips the cable head 210 and cable clip 208 for disconnection from a socket 203. As shown, the shaft 204 may be attached to the top of the remover 206, and otherwise be offset from the opening area through which the cable is routed, to help prevent the handle 200 from interfering with any cables FIG. 3 is a front view of the tool highlighting the cable remover portion 206 of the tool. The cable remover 206 includes an alignment member 300 and a disconnecting member 302, which in this example is a ball detent mechanism 312. Generally speaking, the alignment member 300 positions the cable remover portion 206 and defines an opening area larger than a conventional cable plug head 210 for which the tool is intended for use. Once positioned properly, with the head within the remover portion, the disconnecting member 302 may actuate the cable clip 208 and grip the cable head 210 for disconnection.

More specifically, the alignment member 300 includes two bounding members 306 extending from opposing sides of a transverse member 304. The bounding member 306 and transverse member 304 collectively form a U in cross section. The bounding member 306 and transverse member 304 may be formed from a rectangular aluminum or steel blank, or may be molded plastic, or may be formed of other material and by other means. In some implementations, the cable remover 206 and a shaft may be formed of a non-conductive or substantially non-conductive material. As shown, flanges 308 A, B may extend inward from the opposing members 306. The flanges 308 A, B may be parallel to the transverse member 304. As shown in the side view, the flanges 308 A, B may extend the length of the respective member 306. However, the flanges 308 A, B may also be inwardly extruding tabs, teeth, or other structure, and may be formed of the same material as the member 306 or may be connected thereto through bonding, adhesion, or otherwise and may be a compliant, flexible, resilient material. When the cable remover 206 is moved in the direction of arrow A (FIG. 1), the open end of the cable remover 206 positions and receives the plug 112. The alignment member 300 positions the plug 112 such that the disconnecting member 302 can receive and actuate the cable clip 208 and grip the cable head 210, as shown in FIG. 2. More specifically, one of the bounding members 306 will about the cable head 210 and prevent the cable head 210 from moving translationally side to side and outside of the cable remover 206 and thus guide the cable head 210 to move translationally towards the disconnecting member 302. Similarly, the flanges 308 A, B prevent the cable head 210 from moving in a downward motion and outside of the cable remover 206.

The disconnecting member 302 is supported inside the alignment member and may be, for example, a ball detent, a ramp, lever, or one-jaw or two-jaw mechanism to actuate and grip the plug 112 for disconnection from a socket 203. The disconnecting member 302 may thus be a static device that actuates the plug 112 and grips it through proper positioning of the tool or may be an actuatable device that actively depresses the cable clip 208 and grips the plug 112. Various possible disconnecting member mechanisms are discussed herein. A ball detent 312 is shown in FIGS. 1-3 as one example of a disconnecting member 302. The ball detent 312 includes a ball 314, a spring 318, a pair of catch tabs 320, and a first wall 316 and a second wall 322. The spring 318 is supported between the ball 314 and the transverse member 304. The first wall 316 and the second wall 322 are supported on the transverse member 304 and bound the ball 314 on opposite sides of the ball 314 so that the ball 314 can only move upwards or downwards. The catch tabs 320 are supported on the flanges 308 and mechanically catch the bottom of the cable head 400 so that the cable head 210 can be removed from the socket 203.

After the member 206 also aligns and positions the internal component over the plug 112 for disconnection, actuation occurs automatically or manually when the cable remover 106 is pushed towards the cable head 110. The disconnecting member 302 pushes the cable clip 208 down and causes the flanges 308 A, B and the transverse member 304 to squeeze and grip the cable head 210 so that a user can pull the entire cable 212 out of the socket 203. More specifically, the cable clip 208 will contact the ball 314 and when the user applies enough translational force the spring 318 will depress and translate the ball 314, against the spring force, so that the cable clip 208 can slide under the ball 314. The rounded surface of the ball 314 also allows the tab 208 to move under the ball 314. The force of the spring pushes the ball 314 down onto the cable clip 208 until the cable clip 208 is depressed. Also, when the user moves the cable remover 206 over the plug 112 the ball detent 312 causes the catch tabs 320 to press against and slide on a first contact surface 402 of a ledge 400. When the user moves the cable tool 202 so that the catch tabs 320 slides past the contact surface 402, the force of the ball detent 312 causes the catch tabs 320 to move upwards so that the catch tabs 320 press against a second contact surface 404. As the user pulls the cable tool 202 away from the machine, the catch tabs 320 press against a catch surface 406 and the catch tabs 320 together with the ball detent 312 pressing against the cable clip 208 and cable head 210 mechanically grip the plug 112 for disconnection from the socket 203.

Figure 5:
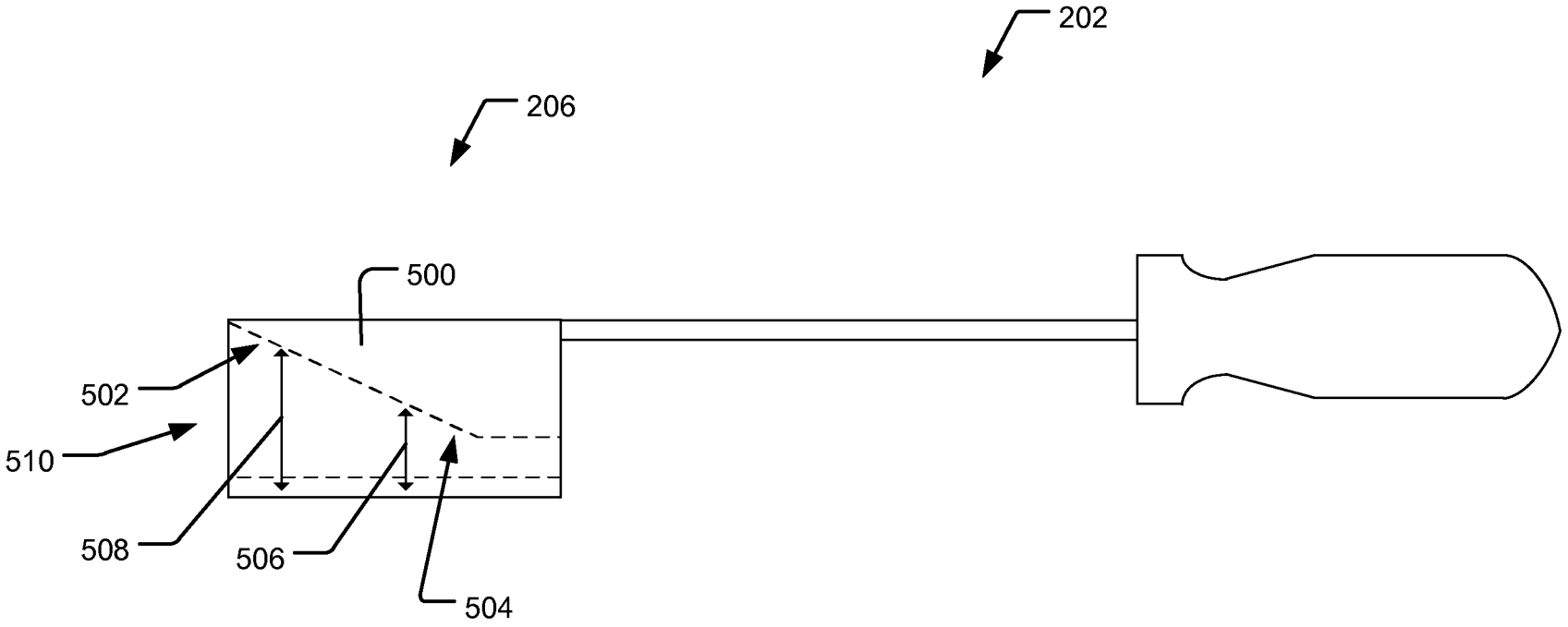
FIG. 5 illustrates an example cable extraction tool with a ramp.

FIG. 5 illustrates an example embodiment of the disconnecting member 302. A ramp 500 is supported inside the cable remover 206. The ramp 500 includes a first portion 502, where the plug 112, shown in FIG. 2A, is received and a second portion 504 with a surface 610, shown in FIG. 6, where the plug 112 is actuated and gripped. A cross section of the ramp 500 may be a trapezoid shape or otherwise provide a sloped surface. In the example illustrated, the disconnecting member 302 includes an opening 510 and the ramp 500 continuously narrows the opening 510 along the longitudinal length of the disconnecting member 302 such that as the disconnecting member 302 is pushed over the plug 112, the ramp surface and narrowing opening 510 will actuate the cable clip 208 and grip the plug 112. An opening 510 is maintained through which the cable 207 may extend. The entire ramp 500 may be formed of the same material as the alignment member 300 or may be formed from an aluminum or steel blank or molded plastic, or may be formed of some other material and by other means. The ramp 500 may also be coated with or formed in full or in part from a flexible resilient material to help grip the plug for extraction. The second portion 504 may include a surface 610 that provides more gripping potential. The surface 610, for example may be rubber, rubberized or a similar synthetic material, and may be adhered on the surface 610 or formed of some other material. Furthermore, the cable remover 206 may have catch tabs 320, as shown in FIGS. 2-4 and described in paragraph 24, to mechanically grip the cable 207 for disconnection from the socket 203. A first distance 508 between the transverse member 304 and the flanges 308A, B in the first portion 502 is greater than a second distance 506 between the transverse member 304 and the flanges 308 A, B, in the second portion 504. When the cable tool 202 receives the plug 112 in the first portion 502, the alignment member 300 positions the plug 112 for actuation. When the cable tool 202 is translationally moved in the direction of arrow B, the cable clip 208 is actuated due to the second distance 506 in the second portion 504 being less than the first distance 508 in the first portion 502. More specifically, the second portion 504 pushes down on the cable clip 208, which is more flexible than the cable head 210, and the flanges 308 A, B keep the cable head 210 stationary, which releases and allows the plug 112 to be disconnected from the socket 203.

Figure 6A:
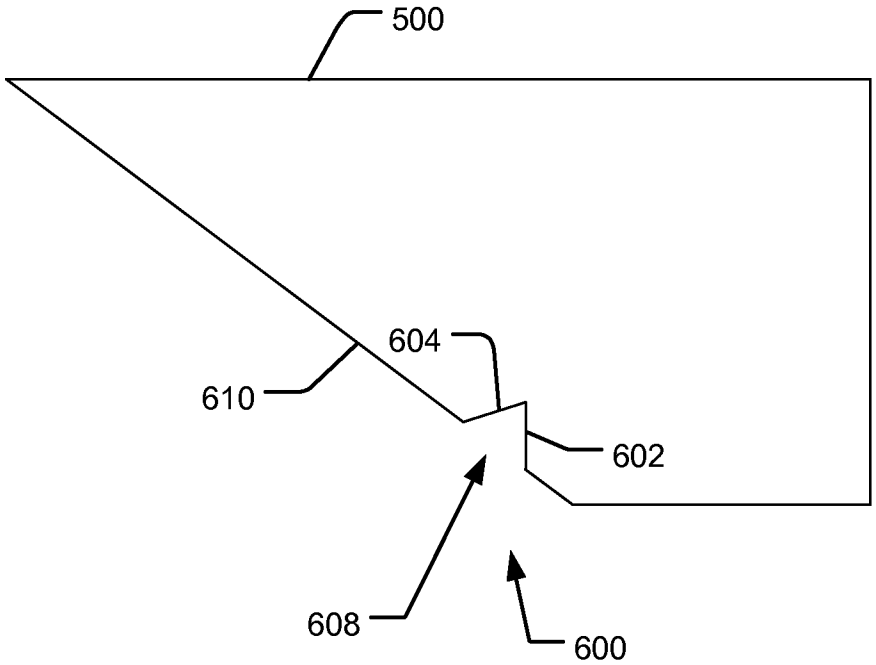
FIGS. 6A and 6B show a side view and a bottom view, respectively, of the ramp of FIG. 5 with a notch.
Figure 6B:
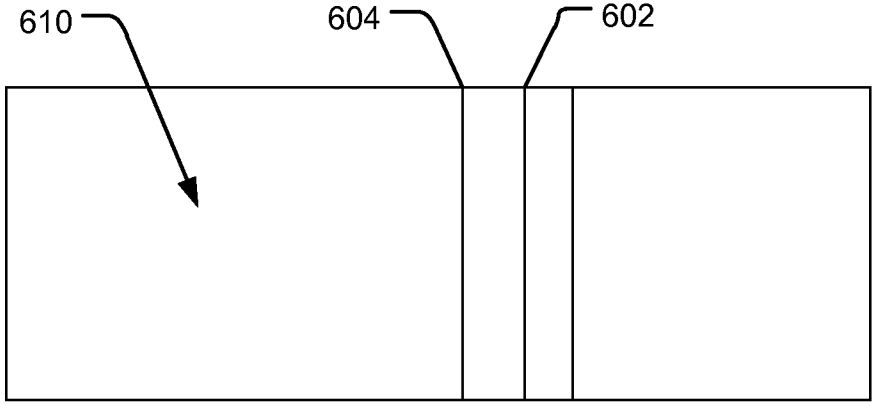
Figure 7A:
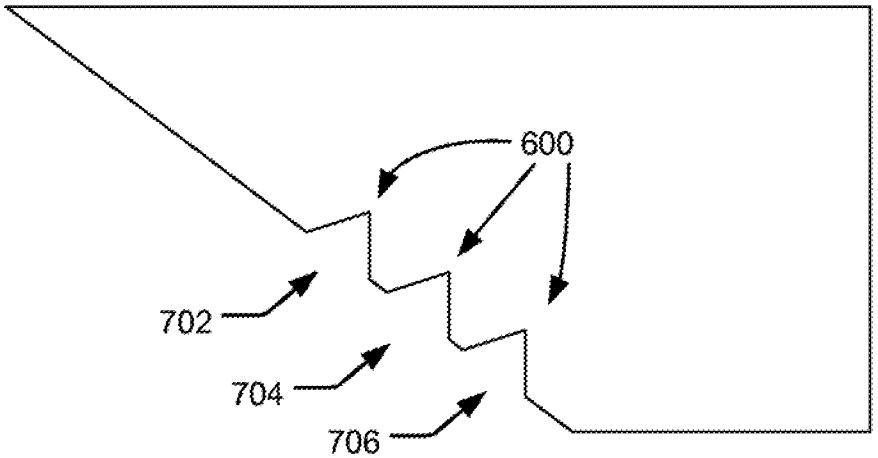
FIGS. 7A and 7B show a side view and a bottom view, respectively, of the ramp of FIG. 5 with a plurality of notches.
Figure 7B:
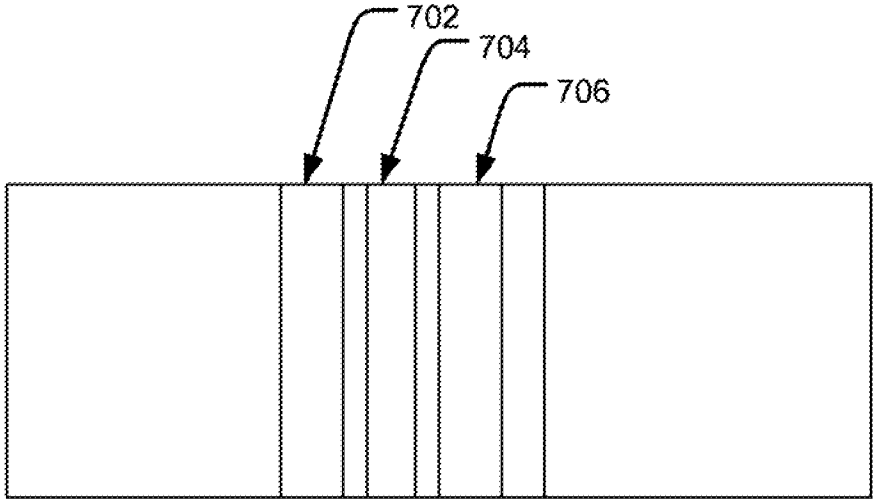

FIGS. 6-7 illustrate a notch and a plurality of notches on the second portion 504, respectively. FIG. 6A illustrates an example embodiment of the notch 600 on the ramp 500, which includes at least a first side 604, a second side 602, and an opening 608. The notch 600 may be created by machining the notch 600 with a specialty drill, or the like, or by hand cutting the notch with a tool, or by forming the notch in a mold for casting plastic. When the cable clip 208 is actuated in the second portion 504, as described in paragraph 25, the notch 600 will receive the cable clip 208 in the opening. The user will feel a small resistance as the second side 602 presses against the tip of the cable clip. Furthermore, the notch 600 may be designed so that a click noise is heard when cable clip 208 is received in the opening 608. The notch 600 may be positioned so that the small resistance and the click noise will alert a user that the user has sufficiently pushed the second portion 504 far enough to engage the cable clip 208 and cable head 210. When the user adds more force, the second portion 504 of the ramp and the flanges 308 A, B frictionally grip the plug 112 for disconnection from a socket 203. FIG. 7 illustrates an example embodiment of the second portion comprising a plurality of notches, of which the individual notches 600 were previously described in FIG. 6. The plurality of notches can alert a user as to the positioning of the plug 112. For example, the first notch 702 can be positioned so that when the user engages the first notch 702, the user knows that the cable clip 208 is beginning to depress. The second notch 704 can be positioned so that the user knows that the cable clip 208 is almost fully actuated and gripped by the second portion 504. Lastly, the third notch 706 can be positioned so that the user knows that the cable clip 208 is fully actuated and gripped by the second portion 504. By having three notches, a user can correct a mistake, for example, a user may engage the first notch 702, then realize that the user is on the wrong cable. Because the user is still in the first notch 702 and the cable clip 208 and cable head 210 are not fully actuated and gripped, the user can still remove the cable tool 202 before disconnecting the wrong plug.

Figure 8:
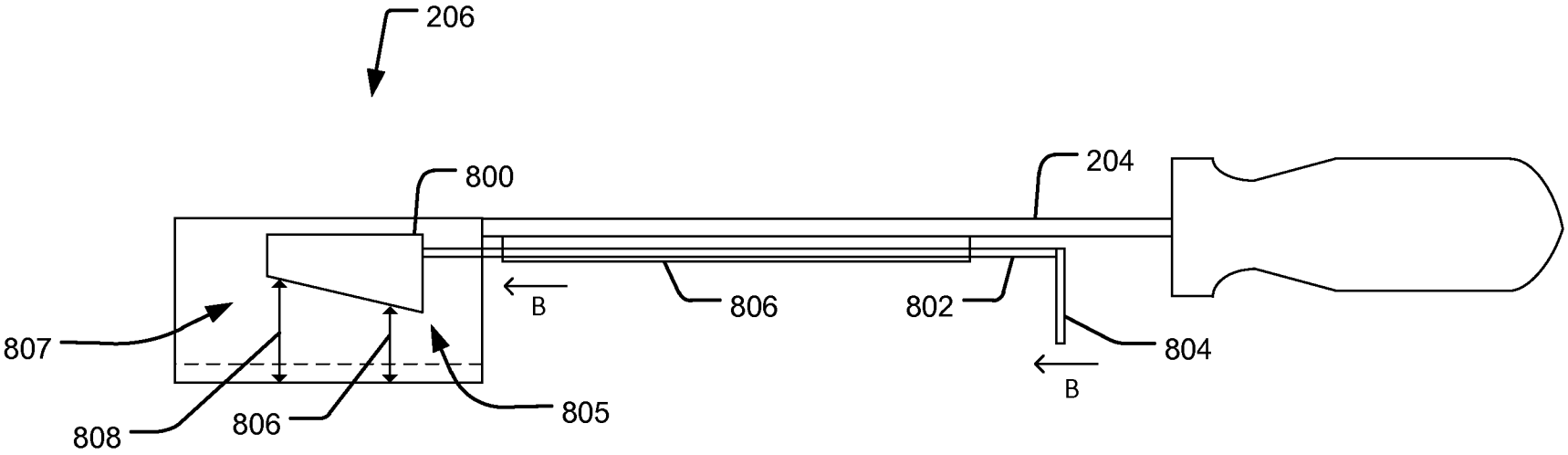
FIGS. 8 and 9 illustrate an example cable extraction tool with a translational ramp in an unengaged and an engaged position, respectively.
Figure 9:
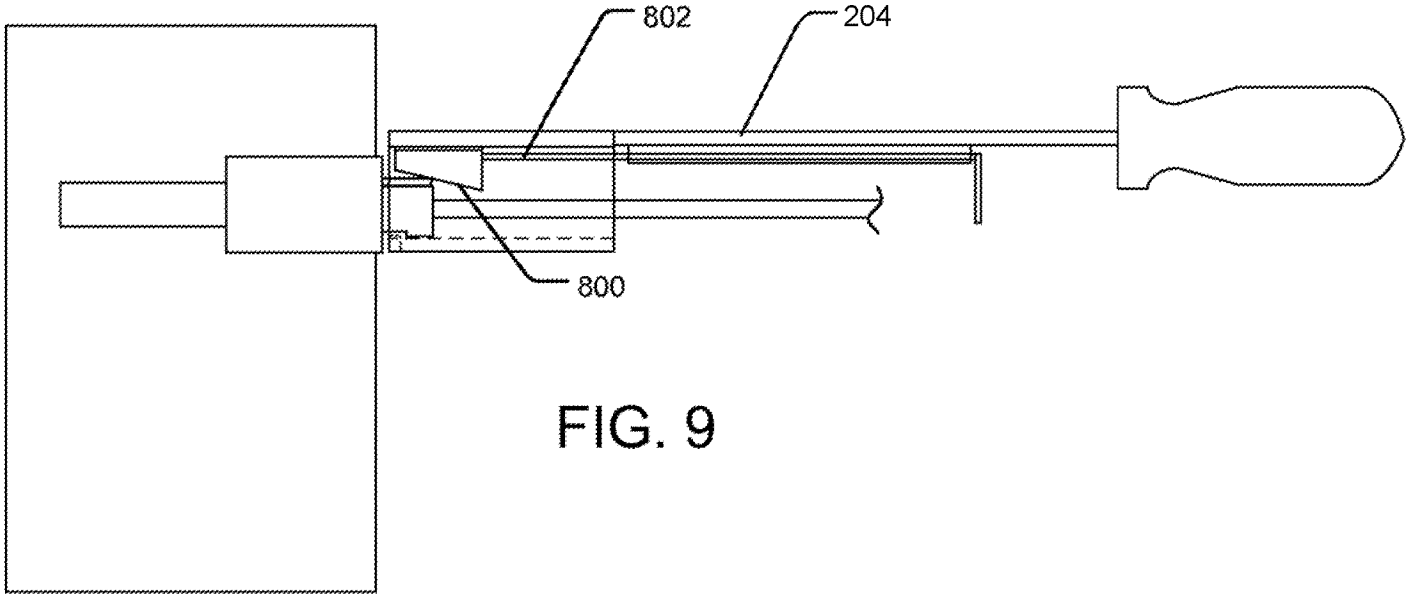
Figure 10:
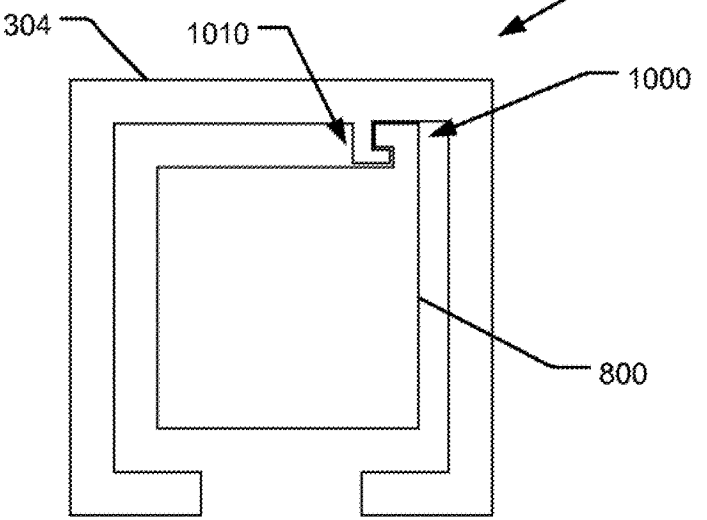
FIG. 10 illustrates the translational ramp of FIG. 8 with a track and an alignment member with a receiving track.
Figure 11:
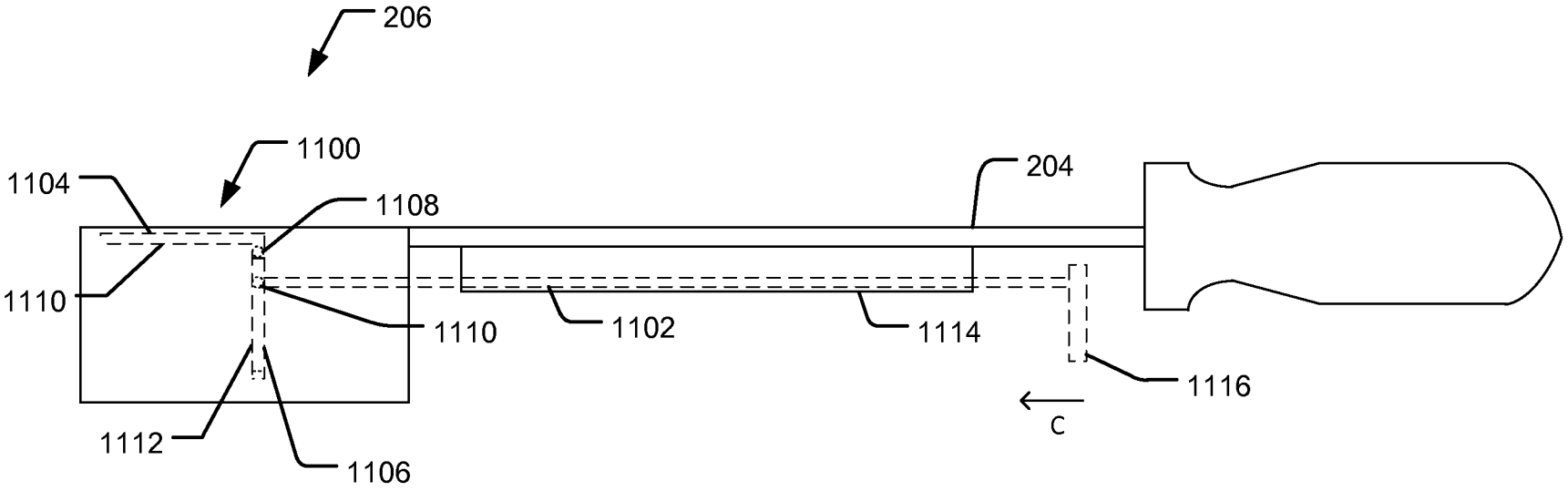
FIGS. 11 and 12 illustrate an example cable extraction tool with a one-jaw mechanism in an open and closed position, respectively.

FIGS. 8-10 illustrate another example embodiment of the disconnecting member 302 with a translational ramp 800 in the unengaged and engaged position, respectively. A translational ramp 800 is supported on the cable remover 206 and is connected to a rod 802 that actuates the ramp 800. The rod 802 extends from the translational ramp 800 to a protruding member 804 which may be, for example, a tab, handle, or some other shape projecting from the rod 802. The rod 802 may be made of aluminum, steel, or plastic, or some other material and may have a cross section of a circle, square, star, or some other shape. The rod 802 may be supported on the shaft by a guideway 812 and may be parallel to the shaft 204. The guideway 812 defines a longitudinal barrel running parallel to the shaft 204. The guideway 812 may also be integrated to the shaft 204. The guideway 812 may be made of the same material as the shaft 204, or may be made of aluminum, steel, or plastic and then adhered or connected to the shaft 204. The rod 802 is supported in the guideway 812 and through pressing or pulling on the protruding member 804 moves the translational ramp 800 fore and aft relative to the disconnecting member body.

The ramp 800 is supported on the end of the rod 802, and may also be supported on some portion of the disconnecting member 302. For example, the ramp 800 may include tabs that are secured in corresponding slots of the disconnecting member 302. The ramp may define slots that receive tabs or other projection from the connector. The connector may define an elongate longitudinal slot that receives a tab in the corresponding wall of the ramp FIG. 10 illustrates the translational ramp 800 with an example track flange 1000 and the alignment member 300 with an example track channel 1010. The translational ramp 800 would include a track flange 1000 connected on the longest edge that is closest to the transverse member 304. The transverse member 304 includes a track channel 1010 sized to fit the track flange 1000 and allows the track flange 1000 to transversely move within the track channel 1010.

The member 804 allows the user to transfer the user's translational force to the translational ramp 800 and cause the translational ramp 800 to move in the direction of the arrow B. The rod 802 allows the user to operate the translational ramp 800 while keeping the user's hand away from the cable head 210. As described above, the translational ramp 800 has a first portion 808, where the cable head 210 initially makes contact, and a second portion 810 with a surface 816 where the cable clip 208 is actuated and the cable head 210 is gripped. The first portion 807 has a first distance 808 from the translational ramp 800 to the flanges 308A, B and the second portion 805 has a second distance 806 from the translational ramp 800 to the flanges 308A, B, which is less than the first distance 808. The second portion 805 may include a surface 900 that provides more gripping potential. The surface, for example may be rubber, rubberized or a similar synthetic material, and may be adhered on the surface 900 or formed of such a material. Furthermore, the cable remover 206 may have catch tabs 320, as shown in FIGS. 2-4 and described in paragraph 24, to mechanically grip the plug 112 for disconnection from the socket 203.

When a user positions the cable remover 206 on the plug 112, the alignment member 300 positions the plug 112 for actuation and gripping. A user then pushes the member 804 in the direction of the arrow B, which causes the translational ramp 800 to move in the same direction. The first portion 807 of the translational ramp 800 makes contact with the cable clip 208 and together with the bounding members 306 and flanges 308 A, B guides the translational ramp 800 forward onto the cable clip 208. Additionally, the first portion 807 begins pushing cable clip 208 downward so that the cable head 210 abuts the flanges 308 A, B, which prevent the cable head 210 from moving downward and fixes the cable head 210. As the translational ramp 800 continues to move forward, the second portion 805 of the translational ramp 800 then actuates the cable clip 208 by pushing the cable clip 208 downward. More specifically, the second distance 806 is less than the first distance 808 such that when the translational ramp 800 is moved towards the cable head 210 and cable clip 208, the cable clip 208, being flexible, moves downward towards the cable head 210, which is fixed from moving downward by the flanges 308 A, B, and allows the cable clip 208 and cable head 210 to fit into a portion of the second distance 804. When the cable head 210 and cable clip 208 can no longer compress, the cable head 210 and cable clip 208 are frictionally engaged by the second portion 804 and the flanges 308 A, B. FIG. 9 shows the translational ramp 800 in an engaged position. A user can then pull the tool 202 away from the socket 203, which pulls the plug 112 from the socket 203. When the user releases the protruding member 804, the translational ramp 800 releases the plug 112. The protruding member 804 can be released manually, by a user pulling the protruding member 804 back into its original position, or by some automatic protruding member 804 release mechanism, such as a spring or the like. Additionally, as described in paragraph 26, the second portion 804 may have a notch or a plurality of notches, which may alert a user as to the position of the plug in relation to the cable remover.

FIGS. 11-14 illustrate another embodiment of the disconnecting member 302 with a one-jaw mechanism 1100 in the open position, in the closed position, a detailed front view of the one-jaw mechanism 1100 and alignment member 300, and an isometric detailed view of the second jaw member 1106 and the rod 1102, respectively. A one-jaw mechanism 1100 is supported on the cable remover 206 and is also supported on a rod 1102. The one-jaw mechanism 1100 includes a first jaw member 1104 and at least a second jaw member 1106 connected to the first jaw member 1104 by a hinge 1108, or the like, which is detailed in FIG. 13. The first jaw member 1104 is supported on the transverse member 304 and may be made of aluminum, steel, or plastic, or some other material. The first jaw member 1104 may be made of the same material as the transverse member 304 or may be adhered to the transverse member 304 or connected by some other means. The first jaw member 1104 includes a surface 1110 which contacts and actuates the cable clip 208. The second jaw member 1106 may be made of the same material as the first jaw member 1104 and includes flanges 1300 with a second surface 1112 which contacts and grips the cable head 210. The first surface 1110 or second surface 1112, or both, may have a flexible, resilient surface to provide more friction during contact. The first surface 1110 and the second surface 1112 may also have a tooth or teeth to provide more surfaces for gripping. The distance 1302 between the second jaw member flanges 1300 allows a cable 207 to enter the cable remover 206 portion so that a user can move the cable remover 206 along a cable 207.

Figure 14:
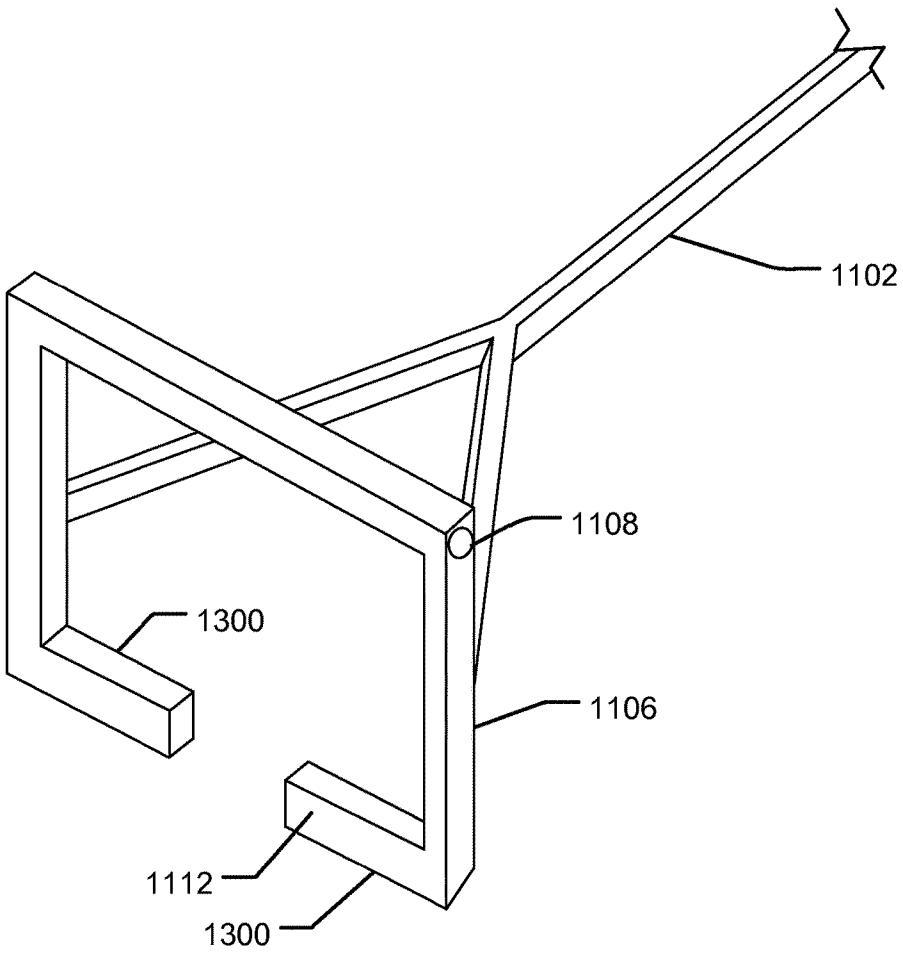
FIG. 14 is an isometric detailed view of a second jaw member and a rod.

The rod 1102 extends from the second jaw member 1106 to a protruding member 1116 which may be, for example, a tab, handle, or some other shape projecting from the rod 1102. The rod 1102 may be connected to the second jaw member 1106 by a hinge 1120 or connected by some other means. The rod 1102 may be made of aluminum, steel, or plastic, or some other material and may have a cross section of a circle, square, star, or some other shape and may be supported on the shaft 204 by a guideway 1114 and may be parallel to the shaft 204. The guideway 1114 defines a longitudinal barrel running parallel to the shaft 204. The guideway 1114 may also be integrated to the shaft 204. The guideway 1114 may be made of the same material as the shaft 204, or may be made of aluminum, steel, or plastic and then adhered or connected to the shaft 204. The rod 1102 is supported in the guideway 1114 and through pressing or pulling on the protruding member 1116 moves the second jaw member 1106 in an arc towards the first jaw member 1104. A portion of the rod 1102 distal the second jaw member 1106 or the entire rod 1102 may be made of a flexible and resilient material so that the second jaw member 1106 is free to move in an arc, otherwise a majority of the translational force will be transferred to the joint where the second jaw member 1106 and the rod 1102 are connected rather than transferred to movement of the second jaw member 1106 in an arc. FIG. 14 shows an example embodiment of the second jaw member 1106 and the rod 1102. The rod 1102 may end in a Y-shape so that the rod 1102 can connect to both sides of the second jaw member 1106 between the flanges 1300 and the hinge 1108. The rod 1102 may also only connect to one side of the second jaw member 1106 if the second jaw member 1106 only has one side.

Figure 12:
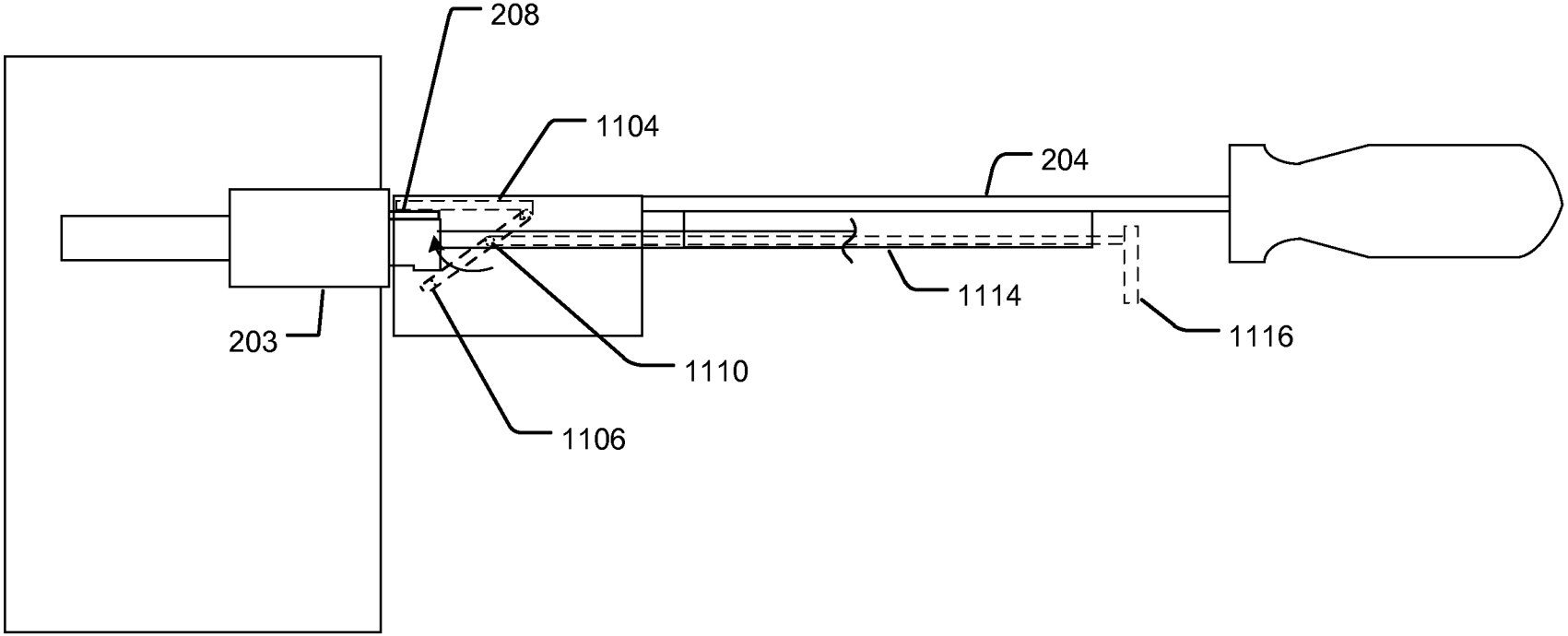
Figure 13:
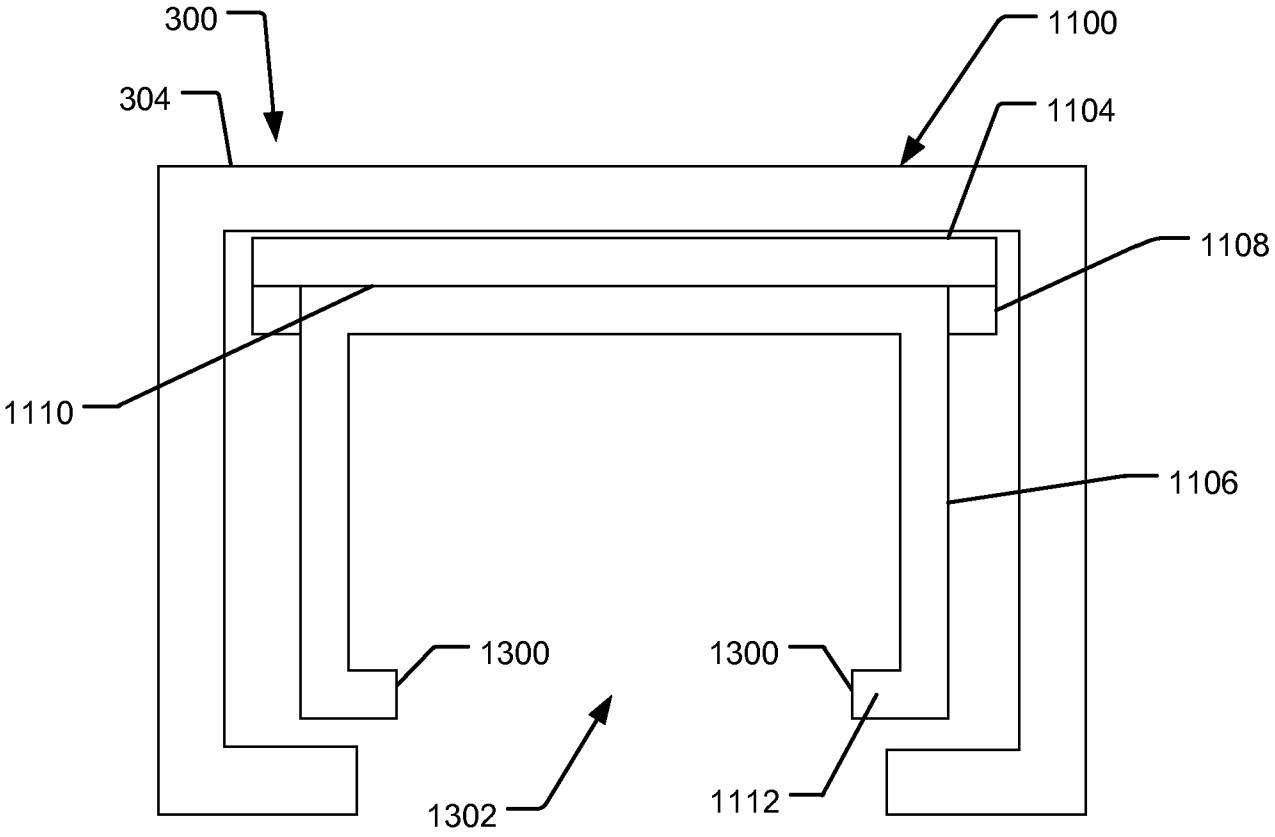
FIG. 13 illustrates a detailed front view of the one-jaw mechanism and an alignment member, with a shaft, a rod, a guideway, and a handle removed for clarity.

When a user positions the cable remover 206 on the plug 112, the alignment member 300 positions the plug 112 for actuation and gripping. A user then pushes the protruding member 1116 in the direction of an arrow C, which causes the second jaw member 1106 to move in an arc towards the first jaw member 1104. When the second jaw member 1106 contacts the cable head 210, at the first contact surface 402 or the second contact surface 404, the cable head 210 moves towards the first jaw member 1104. Because the first jaw member 1104 is fixed, when the cable clip 208 contacts the surface 1110 of the first jaw member 1104 the cable clip 208, which is more flexible than the cable head 210, begins to move towards the cable head 210, which is being moved towards the first jaw member 1104 by the second jaw member 1106. When the cable clip 208 is actuated, the second jaw member 1106 continues to move in an arc towards the first jaw member 1104 and causes the second surface 1112 to frictionally engage the cable head 210. Because the surface of the first member 1110 is also frictionally engaging the cable clip 208, the first jaw member 1104 and second jaw member 1106 work together to grip the cable head 210 and cable clip 208 and allows a user to pull the entire plug 112 out of the socket 203. FIG. 12 shows the one-jaw mechanism 1100 in a closed position. A user can then pull the tool 202 away from the socket 203, which pulls the plug 112 from the socket 203. When the user releases the protruding member 1116, the one jaw mechanism 1100 releases the plug 112. The protruding member 1116 can be released manually, by a user pulling the protruding member 1116 back into its original position, or by some automatic protruding member release mechanism such as a spring or the like.

Figure 15:
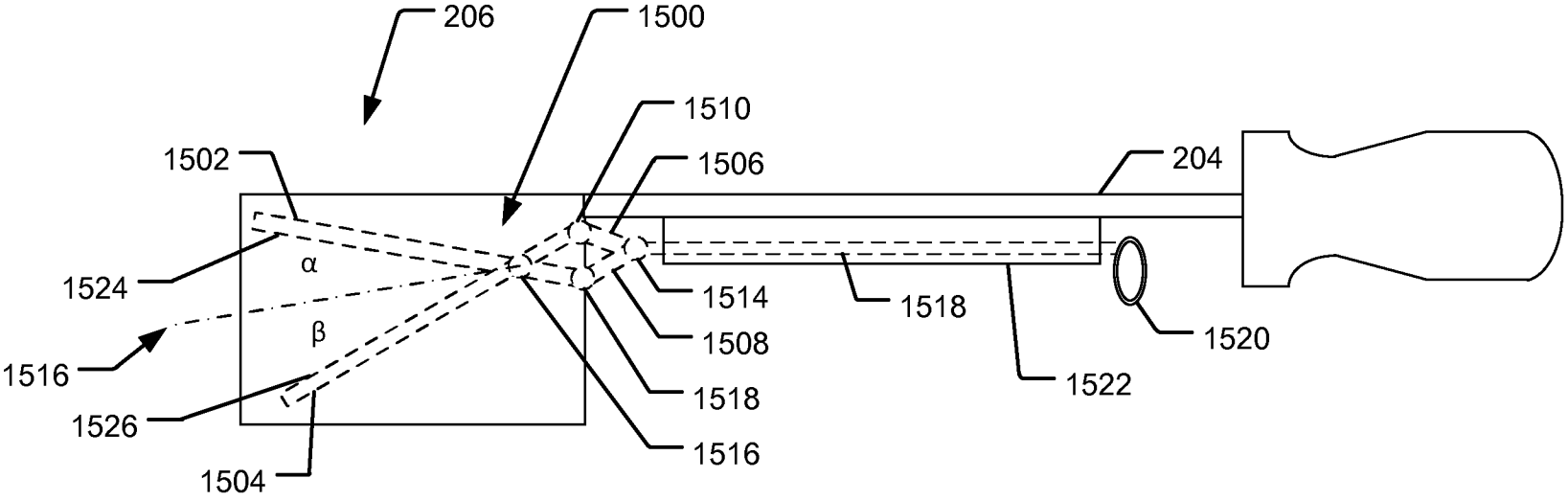
FIGS. 15 and 16 illustrate an example cable extraction tool with a two-jaw mechanism in an open and closed position, respectively.
Figure 16:
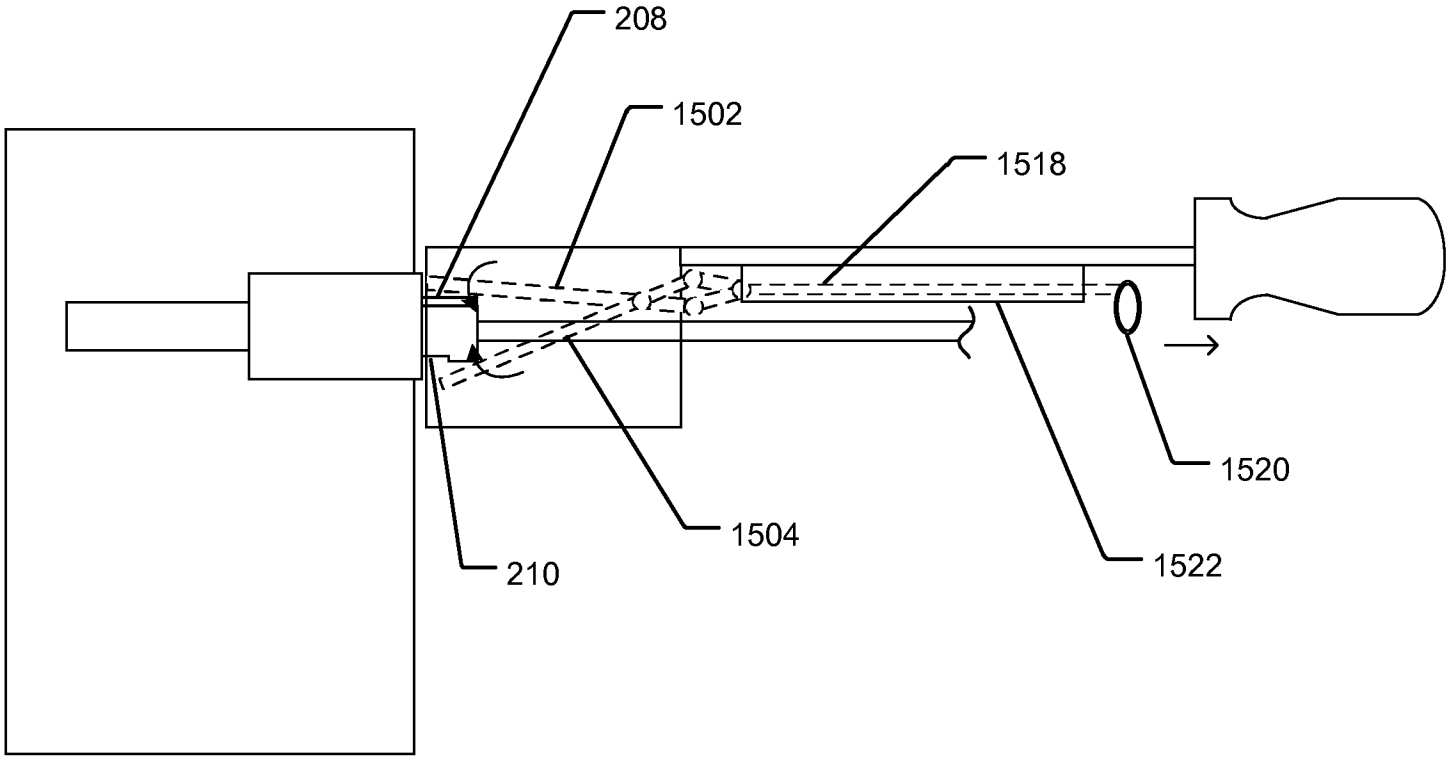

FIGS. 15-16 illustrate another embodiment of the disconnecting member 302 with a two-jaw mechanism 1500 in the open and closed position, respectively. The two-jaw mechanism 1500 is similar to the one-jaw mechanism except that both jaw members move towards a center line 1516, as opposed to one jaw member moving towards a stationary jaw member. Also, rather than pushing the protruding member 1520 towards the alignment member 300 to actuate the one-jaw mechanism, the protruding member 1502 is pulled towards the user to actuate the two-jaw mechanism 1500.

The two-jaw mechanism 1500 includes a first link 1502, a second link 1504, a third link 1506 that is shorter than the second link 1504, and a fourth link 1508 that is shorter than the first link 1502 wherein the links can be made of aluminum, steel, or plastic, or some other material. The first link 1502 is connected to the fourth link 1508 by a first hinge 1518, the second link 1504 is connected to the third link 1506 by a second hinge 1510, the third link 1506 and the fourth link 1508 are connected by a third hinge 1514, and the first link 1502 and the second link 1504 are connected by a fourth hinge 1516. The fourth hinge 1516 is fixed on the bounding member 306 and located on the first link 1502 distal the second hinge 1518. Furthermore, the first link 1502 has a first angle $\alpha$ from a centerline 1516 and the second link 1504 has a second angle $\beta$ from the centerline 1516 defined as an angle in the opposite radial direction of the first angle.

The rod 1518 is connected to the third hinge 1514 and extends to a protruding member 1520 which may be, for example, a tab, handle, or some other shape projecting from the rod 1518. The rod 1518 may be made of aluminum, steel, or plastic, or some other material and may have a cross section of a circle, square, star, or some other shape. The rod 1518 may be supported on the shaft 204 by a guideway 1522 and may be parallel to the shaft 204. The guideway 1522 defines a longitudinal barrel running parallel to the shaft 204. The guideway 1522 may also be integrated to the shaft 204. The guideway 1522 may be made of the same material as the shaft 204, or may be made of aluminum, steel, or plastic and then adhered or connected to the shaft 204. The rod 1518 is supported in the guideway 1522 and through pressing or pulling on the protruding member 1520 moves two jaw mechanism 1500. The first link 1502 and the second link 1504 have corresponding first surface 1524, which contacts the cable clip 208, and second surface 1526, which contacts the cable head 210. The first surface 1524 and the second surface 1526 may have a flexible, resilient surface to create more friction when the cable clip 208 or cable head 210 contacts the first surface 1524 or second surface 1526, respectively. The first surface 1524 and the second surface 1526 may also have a tooth or teeth to provide more surfaces for gripping. The third link 1506 and fourth link 1508 translates the translational movement of the rod 1518 to a radial movement of the first link 1502 and the second link 1504.

When a user positions the cable remover 206 on the plug 112, the alignment member 300 positions the plug 112 for actuation and gripping. When the protruding member 1520 is moved translationally away from the third hinge 1514, the third link 1506 and the fourth link 1508 move in an arc towards each other and the corresponding second hinge 1510 and first hinge 1518 also move towards each other in an arc. Simultaneously, the first link 1502 and the second link 1504 move towards a centerline 1516 where the first link 1502 and the second link 1504 would meet. When the first link 1502 or the second link 1504 contacts the cable clip or the cable head, respectively, the cable head 210 or cable clip 208 are stabilized between the first link 1502 and the second link 1504. When the user pulls the protruding member 1520 with more force, the force of the first link 1502 on the cable clip 208 begins to push the cable clip 208 down, which is more flexible than the cable head 210. The second link 1504 pushes upwards on the cable head 210 and stabilizes the cable head 210 so the cable clip 208 can be depressed. After the cable clip 208 is actuated, the first link 1502 and the second link 1504 exert opposing forces on the cable head 210 and cable clip 208 so that the first link 1502 and second link 1504 act as a claw and grips the plug 112. FIG. 14 shows the two-jaw mechanism 1500 in a closed position. A user can then pull the tool 202 away from the socket 203, which pulls the plug 112 from the socket 203. The protruding member 1520 can be released manually, by a user pulling the protruding member 1520 back into its original position, or by some automatic protruding member release mechanism such as a spring or the like. More specifically the first link 1502 may be supported on the transverse member 304 by a spring or some other connection. The spring would return the first link 1502 to its original position after the protruding member 1520 is released by a user.

Although various representative embodiments of this disclosure have been described above with a certain degree of particularity, those skilled in the art could make numerous alterations to the disclosed embodiments without departing from the spirit or scope of the inventive subject matter set forth in the specification. The alignment member may only have one bounding member and/or one flange. Also, there may be more than two notches on the ramp and the notches may have more than two sides and form cross sections of various shapes. Likewise the catch tabs may be pointed, ridged, or have various forms. The ramp track may also be of a different form other than the example hook shown. The second jaw member of the one jaw mechanism may be directly attached to the transverse member instead of attached to another jaw member. Also, the links of the two jaw mechanism may be of different lengths, so long as the first link is longer than the third link and the second link is longer than the fourth link. In other words, the first link and second link may be different lengths so long as the third link and fourth link are shorter.

Furthermore, all directional references (e.g., upper, lower, upward, downward, left, right, leftward, rightward, top, bottom, above, below, vertical, horizontal, clockwise, and counterclockwise) are only used for identification purposes to aid the reader's understanding of the embodiments and do not create limitations, particularly as to the position, orientation, or use of the disclosure unless specifically set forth in the claims. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

In some instances, components are described with reference to "ends" having a particular characteristic and/or being connected to another part. However, those skilled in the art will recognize that the present disclosure is not limited to components which terminate immediately beyond their points of connection with other parts. Thus, the term "end" should be interpreted broadly, in a manner that includes areas adjacent, rearward, forward of, or otherwise near the terminus of a particular element, link, component, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. A tool comprising:

a shaft;

an alignment member supported on the shaft, the alignment member comprising a transverse member with a first bounding member extending from one end of the transverse member and a second bounding member extending from an opposing end of the transverse member, the first bounding member including a first flange extending from the first bounding member and separated from the transverse member by a first distance spacing the transverse member and the first flange to receive a cable plug therebetween, the second bounding member including a second flange extending from the second bounding member and separated from the first flange by an opening sized for a cable coupled to the cable plug; and a disconnecting member supported on the alignment member, the disconnecting member comprising a one jaw mechanism supported on the alignment member, the one jaw mechanism connected with a rod having a protruding member, the rod translationally coupled with the shaft having a handle supported on the shaft, the one jaw mechanism having a jaw member hinged to the transverse member, the rod supported on the jaw member whereby the protruding member causes the jaw member to move in an arc towards the transverse member whereby the transverse member and the jaw member actuates cable clip portion and grips the cable plug.

2. The tool of claim 1 wherein at least a portion of the rod distal the jaw member is made of a flexible and resilient material.

3. The tool of claim 1 wherein the rod is translationally coupled with the shaft at a guideway, the guideway is supported on the shaft distal the handle supported on the shaft and distal the alignment member, the guideway defining an aperture through which the rod extends.

4. A tool comprising:

a shaft;

an alignment member supported on the shaft, the alignment member comprising a transverse member with a first bounding member extending from one end of the transverse member and a second bounding member extending from an opposing end of the transverse member, the first bounding member including a first flange extending from the first bounding member and separated from the transverse member by a first distance spacing the transverse member and the first flange to receive a cable plug therebetween, the second bounding member including a second flange extending from the second bounding member and separated from the first flange by an opening sized for a cable coupled to the cable plug; and a disconnecting member supported on the alignment member, the disconnecting member comprising a two jaw mechanism supported on the alignment member, the two jaw mechanism connected with a rod having a protruding member, the rod translationally coupled with the shaft having a handle supported on the shaft, the two jaw mechanism having at least a first link, a second link, a third link being shorter than the second link, and a fourth link being shorter than the first link, the first link connected to the fourth link by a first hinge, the second link connected to the third link by a second hinge, the third link and the fourth link connected by a third hinge, the first link and the second link connected by a fourth hinge wherein the first link has a positive angle from a centerline defined by a line extending from the fourth hinge and between the first link and the second link and the second link has a negative angle from the centerline, the fourth hinge located on the first link distal the second hinge and fixed, the rod connected at the third hinge whereby the protruding member causes the first link and second link move in an arc towards the center line when the rod is moved translationally away from the third hinge and whereby the first link and the second link actuates a cable clip portion and grips the cable plug.

5. The tool of claim 4 wherein the rod is translationally coupled with the shaft at a guideway, the guideway is supported on the shaft distal the handle supported on the shaft and distal the alignment member, the guideway defining an aperture through which the rod extends.

6. The tool of claim 5 wherein the first link is supported on the transverse member by a spring.

* * * * *